US008086142B2

(12) United States Patent
Gilmartin et al.

(10) Patent No.: US 8,086,142 B2
(45) Date of Patent: Dec. 27, 2011

(54) BIAS CHARGE ROLLER COMPRISING OVERCOAT LAYER

(75) Inventors: Brian P. Gilmartin, Williamsville, NY (US); Liang-Bih Lin, Rochester, NY (US); Jeanne M. Koval, Marion, NY (US); Aaron M. Stuckey, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 51 days.

(21) Appl. No.: 12/706,951

(22) Filed: Feb. 17, 2010

(65) Prior Publication Data

US 2011/0200361 A1 Aug. 18, 2011

(51) Int. Cl.
*G03G 15/02* (2006.01)

(52) U.S. Cl. ..... 399/176

(58) Field of Classification Search ..... 399/174, 399/176, 279, 286, 313, 357; 492/18, 59; 361/221

See application file for complete search history.

(56) References Cited

U.S. PATENT DOCUMENTS

| | | | | |
|---|---|---|---|---|
| 3,684,364 | A | 8/1972 | Schmidlin | |
| 5,613,173 | A | 3/1997 | Kunzmann et al. | |
| 6,807,389 | B2 | 10/2004 | Facci et al. | |
| 6,842,594 | B2 | 1/2005 | Frankel | |
| 7,103,304 | B2 * | 9/2006 | Hara | 399/176 |
| 7,177,572 | B2 | 2/2007 | DiRubio et al. | |
| 7,623,812 | B2 | 11/2009 | Kagawa | |
| 7,912,411 | B2 * | 3/2011 | Takagi et al. | 399/286 |
| 2011/0045305 | A1 * | 2/2011 | Gilmartin et al. | 428/423.1 |

FOREIGN PATENT DOCUMENTS

| | | | |
|---|---|---|---|
| JP | 03284770 | A * | 12/1991 |
| JP | 04284475 | A * | 10/1992 |
| JP | 05265311 | A * | 10/1993 |
| JP | 07092774 | A * | 4/1995 |
| JP | 10115977 | A * | 5/1998 |

OTHER PUBLICATIONS

"What is Carbon Black" International Carbon Black Association, 2008, http://www.carbon-black.org/what_is.html, accessed Feb. 16, 2010, 2 pgs.

* cited by examiner

*Primary Examiner* — Robert Beatty
(74) *Attorney, Agent, or Firm* — Fay Sharpe LLP

(57) ABSTRACT

Disclosed are bias charge rollers having an overcoat layer. The overcoat layer comprises a phenolic resin and a conductive agent. The resulting bias charge rollers have reduced streaking and increased service lifetimes.

17 Claims, 6 Drawing Sheets

BIAS CHARGE ROLLER COMPRISING OVERCOAT LAYER

BACKGROUND

The present disclosure relates to overcoat layers useful in bias charge rollers, imaging apparatuses, and the rollers and apparatuses themselves. Among other advantages, the overcoat layers improve the lifetimes of the rollers and apparatuses while limiting streaking.

Electrostatographic and xerographic reproductions may be initiated by depositing a uniform charge on an imaging member, i.e. photoreceptor, followed by exposing the imaging member to a light image of an original document. Exposing the charged imaging member to a light image causes discharge in areas corresponding to non-image areas of the original document while the charge is maintained on image areas, creating an electrostatic latent image of the original document on the imaging member. The latent image is subsequently developed into a visible image by depositing a charged developing material, i.e. toner, onto the photoconductive surface layer, such that the developing material is attracted to the charged image areas on the imaging member. Thereafter, the developing material is transferred from the imaging member to a copy sheet or some other image support substrate to which the image may be permanently affixed for producing a reproduction of the original document. In a final step in the process, the imaging member is cleaned to remove any residual developing material therefrom, in preparation for subsequent imaging cycles.

Various devices and apparatuses have been used to create a uniform electrostatic charge or charge potential on the photoconductive surface of an imaging member before forming the latent image thereon. Charging of the imaging member may be broken down into two types: noncontact and contact charging. Traditionally, noncontact charging has been used. In this method, corona generating devices are utilized to apply a charge to the imaging member. In a typical corona generating device, a suspended electrode, or coronode, comprising a thin conductive wire is partially surrounded by a conductive shield. The device is placed in close proximity to the photoconductive surface of the imaging member. The coronode is electrically biased to a high voltage potential, causing ionization of surrounding air which results in the deposit of an electrical charge on an adjacent surface, namely the photoconductive surface of the imaging member.

Several problems have historically been associated with corona generating devices. Problems include the use of very high voltages, i.e. from 3,000 to 8,000 V, requiring the use of special insulation, inordinate maintenance of corotron wires, low charging efficiency, the need for erase lamps and lamp shields, arcing caused by non-uniformities between the coronode and the surface being charged, vibration and sagging of corona generating wires, contamination of corona wires, and, in general, inconsistent charging performance due to the effects of humidity and airborne chemical contaminants on the corona generating device.

Perhaps the most significant problem with corona generating devices is the generation of ozone and nitrogen oxides. Corona charging ionizes the air between the charging device and the imaging member and some diatomic oxygen ($O_2$) is inevitably converted to ozone ($O_3$). Ozone poses well-documented health and environmental hazards. Nitrogen oxides oxidize various machine components, adversely affecting the quality of the final output print produced.

A bias charge roller is a contact charger that has been developed and overcomes some of the deficiencies of corona generating devices. When used to charge an imaging member, a roller used to create a charge on another surface or substrate is commonly referred to as a bias charge roller. When used to charge an intermediate transfer member that transfers a developed image from an imaging member to a substrate member, this roller is sometimes called a bias transfer roll. Although both may differ in minor details particular to their applications, a bias transfer roll should also be considered a bias charge roller for purposes of this application.

Imaging apparatuses comprising bias charge rollers have a power supply for providing a voltage to the bias charge roller. The power supply may be a part of the bias charge roller or may be a separate component.

Bias charge rollers require their outer layer to have a resistivity within a desired range. Materials with resistivities which are too low will cause shorting and/or unacceptably high current flow to the imaging member. Materials with too high resistivities will require unacceptably high voltages. Other problems which can result if the resistivity is not within the required range include nonconformance at the contact nip and poor toner releasing properties. These adverse effects can also result in the bias charge roller having non-uniform resistivity across the length of the contact member. Other problems include resistivity that is susceptible to changes in temperature, relative humidity, and running time.

Bias charge rollers also cause wear and tear to imaging members because they physically contact the imaging member. One of the more common problems is the appearance of streaks along the process direction, i.e. the circumference, or white and dark spots associated with surface damage. These streaks may result in print defects that can shorten the lifetime of the bias charge roller, the imaging member, and the ink or toner cartridge. Streaking usually develops as a result of the degradation of the bias charge roller material and/or the buildup of debris along the process direction of the roller. Defects include scratches, abrasions, potholes, and the like.

It would be desirable to develop a bias charge roller that reduces streaking and has an increased service lifetime.

BRIEF DESCRIPTION

The present application discloses, in various embodiments, bias charge rollers having an overcoat layer comprising a phenolic resin and a conductive agent. Imaging apparatuses comprising the bias charge rollers are also disclosed. The overcoat layers reduce streaking and increase the service lifetime of the bias charge rollers.

In embodiments, a bias charge roller is disclosed which comprises a conductive core and an overcoat layer. The overcoat layer comprises a phenolic resin and a conductive agent.

The conductive agent may be carbon black. The conductive agent may also be metal oxide particles.

The phenolic resin may comprise from about 96 to about 91 wt % of the overcoat layer. The conductive agent may comprise from about 4 to about 9 wt % of the overcoat layer.

The phenolic resin may be selected from the group consisting of a formaldehyde polymer generated with phenol, p-tert-butylphenol and cresol; a formaldehyde polymer generated with ammonia, cresol and phenol; a formaldehyde polymer generated with 4,4'-(1-methylethylidene) bisphenol; a formaldehyde polymer generated with cresol and phenol; a formaldehyde polymer generated with phenol and p-tert-butylphenol; a nitrile phenolic; an epoxy phenolic; and mixtures thereof. An exemplary phenolic resin is commercially available as Plyophen J-325 or Phenolite J-325.

The overcoat layer may have a thickness of from 1 μm to 15 μm.

In other embodiments, a cartridge for applying an electrical charge to an associated imaging member is disclosed. The apparatus comprises a bias charge roller to be situated in proximity to a surface of the associated imaging member, and a power interface for supplying a voltage to the bias charge roller. The bias charge roller comprises an overcoat layer comprising a phenolic resin and a conductive agent.

An image forming apparatus for forming images on a recording medium is also disclosed. The image forming apparatus comprises an electrophotographic imaging member having a charge-retentive surface to receive an electrostatic latent image thereon, a development component to apply a developer material to the charge-retentive surface to develop the electrostatic latent image to form a developed image on the charge-retentive surface, a transfer component for transferring the developed image from the charge-retentive surface to another member or a copy substrate, a fusing member to fuse the developed image to the copy substrate, and a bias charge roller for applying a charge to the charge-retentive surface. The electrophotographic imaging member comprises a substrate, an electrically conductive layer when the substrate is not electrically conductive, a charge generating layer, and a charge transport layer. The bias charge roller comprises an overcoat layer comprised of a phenolic resin and a conductive agent.

These and other non-limiting characteristics of the disclosure are more particularly disclosed below.

BRIEF DESCRIPTION OF THE DRAWINGS

The following is a brief description of the drawings, which are presented for the purposes of illustrating the exemplary embodiments disclosed herein and not for the purposes of limiting the same.

DETAILED DESCRIPTION

Figure 1:
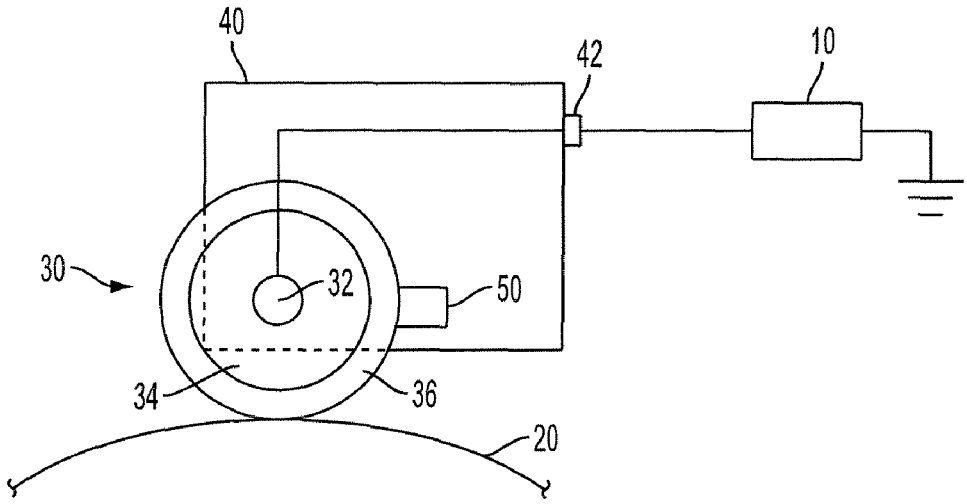
FIG. 1 illustrates an exemplary embodiment of a bias charge roller fabricated according to the present disclosure.

A more complete understanding of the components, processes, and apparatuses disclosed herein can be obtained by reference to the accompanying drawings. These figures are merely schematic representations based on convenience and the ease of demonstrating the present disclosure, and are, therefore, not intended to indicate relative size and dimensions of the devices or components thereof and/or to define or limit the scope of the exemplary embodiments.

Although specific terms are used in the following description for the sake of clarity, these terms are intended to refer only to the particular structure of the embodiments selected for illustration in the drawings, and are not intended to define or limit the scope of the disclosure. In the drawings and the following description below, it is to be understood that like numeric designations refer to components of like function.

The modifier "about" used in connection with a quantity is inclusive of the stated value and has the meaning dictated by the context (for example, it includes at least the degree of error associated with the measurement of the particular quantity). When used in the context of a range, the modifier "about" should also be considered as disclosing the range defined by the absolute values of the two endpoints. For example, the range of "from about 2 to about 10" also discloses the range "from 2 to 10".

The present disclosure relates to overcoat layers that are useful on the bias charge roller of an imaging apparatus. The overcoat layers comprise a phenolic resin and a conductive agent. Bias charge rollers containing the overcoat layer are disclosed.

The present disclosure also relates to a cartridge to be placed in an imaging apparatus. The cartridge is useful for applying an electrical charge to an associated imaging member in the imaging apparatus. The cartridge comprises (1) a bias charge roller that can be situated in proximity to a surface of the imaging member and (2) a power supply for supplying a voltage to the bias charge roller. The bias charge roller comprises an overcoat layer comprised of a phenolic resin and a conductive agent.

Also disclosed is an image forming apparatus for forming images on a recording medium. The image forming apparatus comprises an electrophotographic imaging member having a charge-retentive surface to receive an electrostatic latent image thereon, a development component to apply a developer material to the charge-retentive surface to develop the electrostatic latent image to form a developed image on the charge-retentive surface, a transfer component for transferring the developed image from the charge-retentive surface to another member or a copy substrate, a fusing member to fuse the developed image to the copy substrate, and a bias charge roller for applying a charge to the charge-retentive surface. The electrophotographic imaging member comprises a substrate, an electrically conductive layer when the substrate is not electrically conductive, a charge generating layer, and a charge transport layer. The bias charge roller comprises an overcoat layer comprised of a phenolic resin and a conductive agent.

In FIG. 1, a portion of an image forming apparatus is shown. The image forming apparatus has a power supply 10, an imaging member surface 20, and a bias charge roller 30. One of ordinary skill in the art understands that there may be additional components in the imaging apparatus. The imaging member may be a drum, a belt, a film, a drelt, or any other type of imaging member. The bias charge roller 30 comprises a conductive core and an overcoat layer 36. As shown here, the conductive core is formed from a core 32 and a conductive layer 34.

Figure 2:
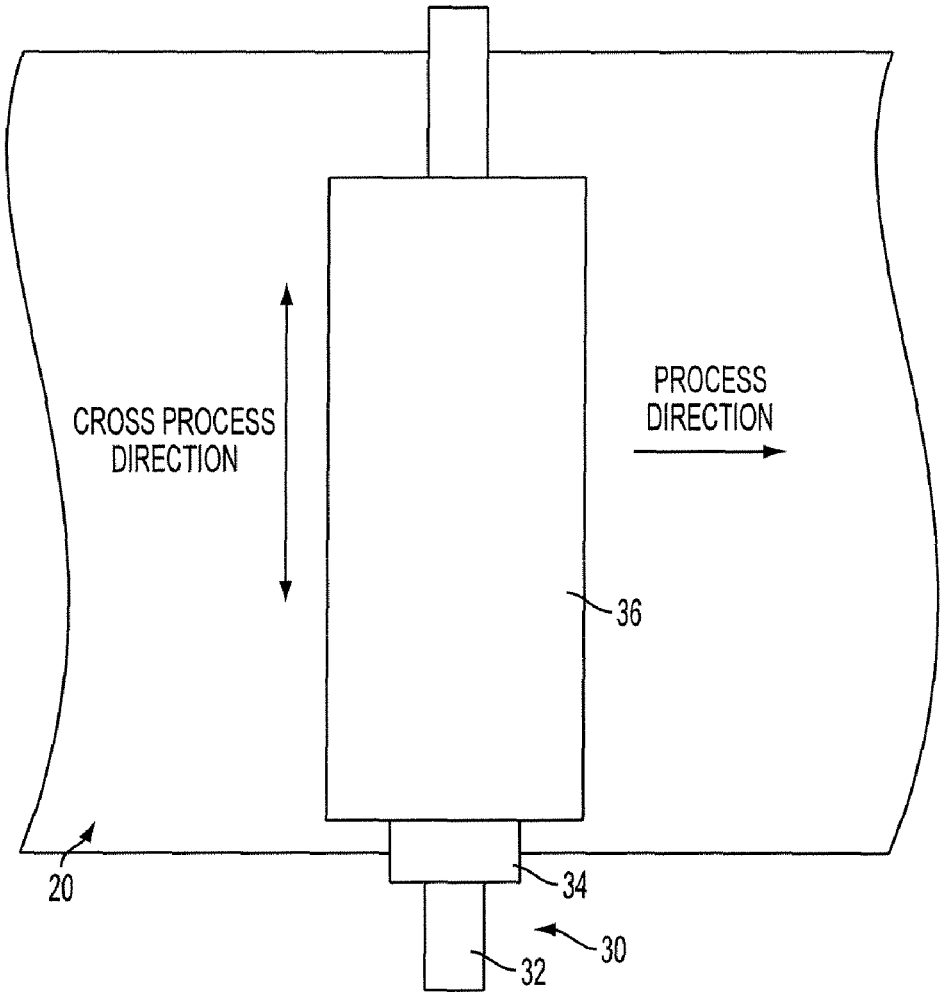
FIG. 2 is a top view of an exemplary embodiment of a bias charge roller illustrating the process direction.

FIG. 2 is a diagram illustrating the operation of the bias charge roller. The bias charge roller rotates about the axis of the core, either under its own power or by friction with the imaging member surface. The direction in which the imaging member surface travels is considered the process direction, and corresponds roughly to a radial direction of the bias charge roller itself, or perpendicular to the axis of the core.

The overcoat layer for the bias charge roller should have a surface resistivity of from $10^5$ to $10^{13}$ ohm/sq in order to achieve good print quality. The overcoat layer should adhere well to the conductive layer. The overcoat layer comprises a phenolic resin and a conductive agent. The term "phenolic resin" refers to a polymeric resin containing repeating units of a six-membered aromatic ring, i.e. phenyl, directly bonded to a hydroxyl group (—OH). The resin may be a homopolymer in some embodiments. The phenolic resin may be a formaldehyde polymer generated with phenol, p-tert-butylphenol and cresol; a formaldehyde polymer generated with ammonia, cresol, and phenol; a formaldehyde polymer generated with 4,4'-(1-methylethylidene) bisphenol; a formaldehyde polymer generated with cresol and phenol; a formaldehyde polymer generated with phenol and p-tert-butylphenol; a nitrile phenolic, an epoxy phenolic; and mixtures thereof. Exemplary phenolic resins are commercially available as Plyophen J-325 from Dainippon Ink and Chemical, Inc. or Phenolite J-325 from DIC Corp.

The phenolic resin may comprise from 99.9 to about 60 wt %, or from about 96 to about 91 wt % of the overcoat layer. In particular embodiments, the phenolic resin comprises about 95 wt % of the overcoat layer.

The conductive agent of the overcoat layer is generally in the form of conductive particles. In some particular embodiments, the conductive agent may be a metal or a metal oxide. The metal of the metal oxide may generally be any conductive metal which can be oxidized. In particular embodiments, the metal may be titanium (Ti), tin (Sn), zinc (Zn), indium (In), silicon (Si), aluminum (Al), zirconium (Zr), or molybdenum (Mb). The conductive particles may alternatively be made from ammonium perchlorates or chlorates, alkali metal perchlorates or chlorates, conductive polymers like polyaniline, polypyrrole, polythiophene, and polyacetylene, and the like.

In other embodiments, the conductive agent is carbon black. Carbon black is a virtually pure elemental carbon in the form of colloidal particles that are produced by incomplete combustion or thermal decomposition of gaseous or liquid hydrocarbons under controlled conditions. Its appearance is that of a black, finely divided pellet or powder. Carbon black is chemically distinct from soot and black carbon. Carbon black generally contains at least 97 wt % elemental carbon arranged as aciniform (grape-like cluster) particulates. In a particular embodiment, the carbon black may be VULCAN® XC72, available from Cabot Corporation, which possesses a density of 264 kg/m$^3$ and an oil absorption number (OAN) of 174 cc/100 g.

The conductive agent may comprise from 0.1 to about 40 wt %, or from about 4 to about 9 wt % of the overcoat layer. In particular embodiments, the conductive agent comprises about 5 wt % of the overcoat layer.

The overcoat layer may have a thickness of from about 0.1 μm to about 500 μm, or from about 1 μm to about 50 μm. In particular embodiments, the overcoat layer has a thickness of from 1 μm to 15 μm, including about 5 μm.

The overcoat layer may be applied by any suitable conventional technique such as spraying, dip coating, draw bar coating, gravure coating, silk screening, air knife coating, reverse roll coating, vacuum deposition, chemical treatment and the like. For convenience, the overcoat layer is preferably applied in the form of a dispersion or solution, where the phenolic resin and conductive particles are dispersed or dissolved in a solvent. Suitable solvents include xylene, 1-butanol, methyl ethyl ketone, and the like and mixtures thereof. The order in which the ingredients are added to the solution/dispersion is not important. The solution/dispersion can be deposited by conventional techniques such as by vacuum, heating and the like. The solvent is removed after deposition of the solution/dispersion by conventional techniques such as by vacuum, heating and the like. The overcoat layer may be cured or dried at a temperature of from about 40 to about 200° C. for a suitable period of time, such as from about 1 minute to about 10 hours, under stationary conditions or in an air flow.

The core 32 of the bias charge roller is used to support the bias charge roller, and may generally be made up of any conductive material. Exemplary materials include aluminum, iron, copper, or stainless steel. The shape of the core may be cylindrical, tubular, or any other suitable shape. The core may have a length of from 200 mm to 700 mm. The diameter of the core may be from about 1 mm to about 20 cm, or from about 5 mm to about 2 cm.

The conductive layer 34 of the bias charge roller surrounds the core 32. The conductive layer comprises a polymeric material such as, for example, neoprene, EPDM rubber, nitrile rubber, polyurethane rubber (polyester type), polyurethane rubber (polyether type), silicone rubber, VITON/FLUOREL rubber, epichlorohydrin rubber, or other similar materials having a DC volume resistivity in the range of $10^3$ to $10^7$ ohm-cm after suitable compounding with a conductive filler such as carbon particles, graphite, pyrolytic carbon, metal oxides, ammonium perchlorates or chlorates, alkali metal perchlorates or chlorates, conductive polymers like polyaniline, polypyrrole, polythiophene, and polyacetylene, and the like. The conductive filler may be present in the amount of from about 1 to about 30 parts by weight per 100 parts by weight of the polymeric material. Desirably, the conductive layer is deformable to ensure close proximity or contact with the imaging member surface. The Shore O hardness is typically from about 15 to about 80. The elastomer may be, for example, urethane rubber, epichlorohydrin elastomers, EPDM rubbers, styrene butadiene rubbers, fluoroelastomers, silicone rubbers, or any other suitable material. The conductive layer may have any suitable thickness such as, for example, about 10 mm to about 20 cm, preferably from about 50 mm to about 3 cm. It is also possible to use a stiff, non-conformable conductive layer.

The power supply 10 may connect to the bias charge roller 30 via the core 32. The voltage provided by the power supply may be a standard line voltage or other voltage levels or signal frequencies which may be desirable in accordance with other limiting factors dependent upon the individual machine design. The power supply may provide a DC voltage, an AC voltage, or variations thereof.

In some applications, the bias charge roller may be provided in the form of a cartridge for easy insertion and removal from the image forming apparatus. As seen in FIG. 1, the cartridge 40 contains the bias charge roller 30. A power interface 42 exists to connect the bias charge roller 30 to the power supply 10 of the image forming apparatus and supply voltage to the bias charge roller. A cleaning member 50 may also be present to remove toner, paper dust, lubricant, etc. that is transferred from the imaging member surface 20 to the bias charge roller 30. The cleaning member may be, for example, a felt, sponge, etc., and may be shaped as, for example, a roller, a plate, or a sheet.

The overcoat layer of the present disclosure improves the lifetime of the bias charge roller and has improved print properties over time, i.e. it does not produce dark streaks. The overcoated bias charge roller also displays excellent charge uniformity. The overcoat layer also allows for refurbishing of a used bias charge roller; after applying the overcoat layer to the damaged surface, the bias charge roller can continue to be used.

Figure 3:
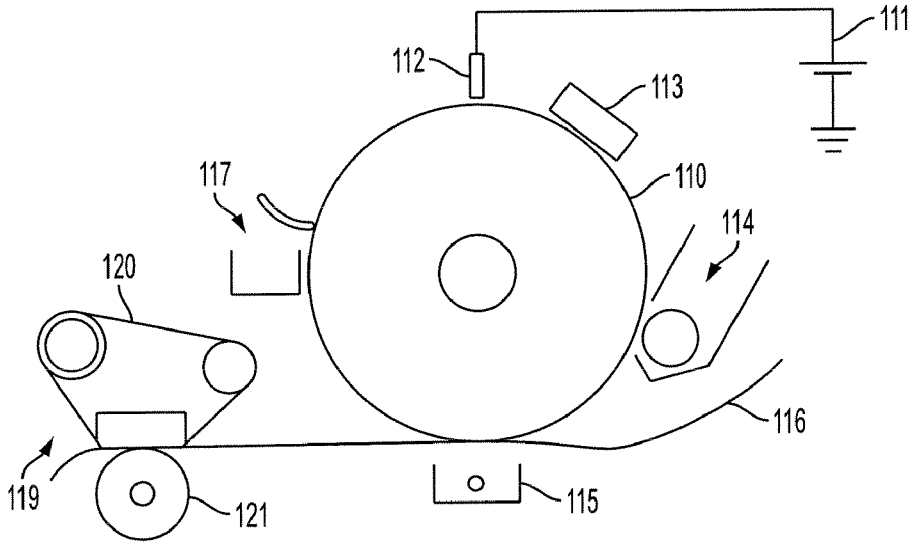
FIG. 3 illustrates an exemplary image forming apparatus of the present disclosure.

The bias charge roller may be used in an image forming apparatus that forms images on a recording medium, such as that shown in FIG. 3. Such an image forming apparatus comprises an electrophotographic imaging member, a development component, a transfer component, and a fusing member. The electrophotographic imaging member has a charge-retentive surface to receive an electrostatic latent image thereon. The electrophotographic imaging member generally comprises a substrate, an electrically conductive layer when the substrate is not electrically conductive, a charge generating layer, and a charge transport layer. Imaging members are known in the art. The bias charge roller applies a uniform charge to the charge-retentive surface. After the electrostatic latent image is generated, the development component applies a developer material, i.e. toner, to the charge-retentive surface to develop the electrostatic latent image and form a developed image on the charge-retentive surface. The transfer component transfers the developed image from the charge-retentive surface to another member or a copy substrate, such as paper. The fusing member fuses the developed image to the copy substrate.

Referring to FIG. 3, the charge-retentive surface of imaging member 110 is charged by bias charge roller 112 to which a voltage has been supplied from power supply 111. The imaging member is then imagewise exposed to light from an optical system or an image input apparatus 113, such as a laser and light emitting diode, to form an electrostatic latent image thereon. Generally, the electrostatic latent image is developed by bringing a developer mixture from developer station 114 into contact therewith. Development can be effected by use of a magnetic brush, powder cloud, or other known development process. A dry developer mixture usually comprises carrier granules having toner particles adhering triboelectrically thereto. Toner particles are attracted from the carrier granules to the latent image forming a toner powder image thereon. Alternatively, a liquid developer material may be employed, which includes a liquid carrier having toner particles dispersed therein. The liquid developer material is advanced into contact with the electrostatic latent image and the toner particles are deposited thereon. After the toner particles have been deposited on the photoconductive surface, they are transferred to a copy substrate 116 by transfer component 115, which can be pressure transfer or electrostatic transfer. Alternatively, the developed image can be transferred to an intermediate transfer member, or bias transfer member, and subsequently transferred to a copy substrate. Examples of copy substrates include paper, transparency material such as polyester, polycarbonate, or the like, cloth, wood, or any other desired material upon which the finished image will be situated. After the transfer of the developed image is completed, copy substrate 116 advances to fusing member 119, depicted as fuser belt 120 and pressure roll 121, wherein the developed image is fused to copy substrate 116 by passing the copy substrate between the fuser belt and pressure roll, thereby forming a permanent image. Alternatively, transfer and fusing can be effected by a transfix application. The imaging member 110 then advances to cleaning station 117, wherein any remaining toner is cleaned therefrom by use of a blade (as shown in FIG. 1), brush, or other cleaning apparatus.

The present disclosure will further be illustrated in the following non-limiting working examples, it being understood that these examples are intended to be illustrative only and that the disclosure is not intended to be limited to the materials, conditions, process parameters and the like recited herein. All proportions are by weight unless otherwise indicated.

EXAMPLES

Comparative Example 1

A bias charge roller without an overcoat layer was used for comparison. The bias charge roller was tested for charge uniformity before being tested (i.e. t=0). The bias charge roller was then cycled 50,000 times in a Hodaka wear rate fixture. The bias charge roller was then tested for charge uniformity (t=50,000). The bias charge roller was also print tested in a copier after the wear testing.

Example 1

An overcoat dispersion was prepared by ball milling a sample of Plyophen J-325 phenolic resin (available from Dainippon Ink and Chemicals, Inc.) with VULCAN® XC72 carbon black (available from Cabot Corporation) in a 50:50 mixture of xylene and butanol. The sample was ball milled for 3 days, after which the dispersion was filtered. A 5 μm overcoat layer was coated on a bias charge roller identical to the one used in Comparative Example 1 using a Tsukiage coater. The bias charge roller was then dried in a convection oven for 15 minutes at 140° C. to remove the solvent and cure the overcoat. The resulting overcoat layer was 5 wt % carbon black and 95 wt % phenolic resin. The surface resistivity of the material was measured to be $10^8$ Ω/sq.

The bias charge roller was tested for charge uniformity prior to wear testing (t=0). The bias charge roller was then cycled 50,000 times in a Hodaka wear rate fixture, and subjected to charge uniformity testing using the same procedure (t=50,000). The bias charge roller was also print tested in a copier after the wear testing.

Charge Uniformity Testing

Figure 4:
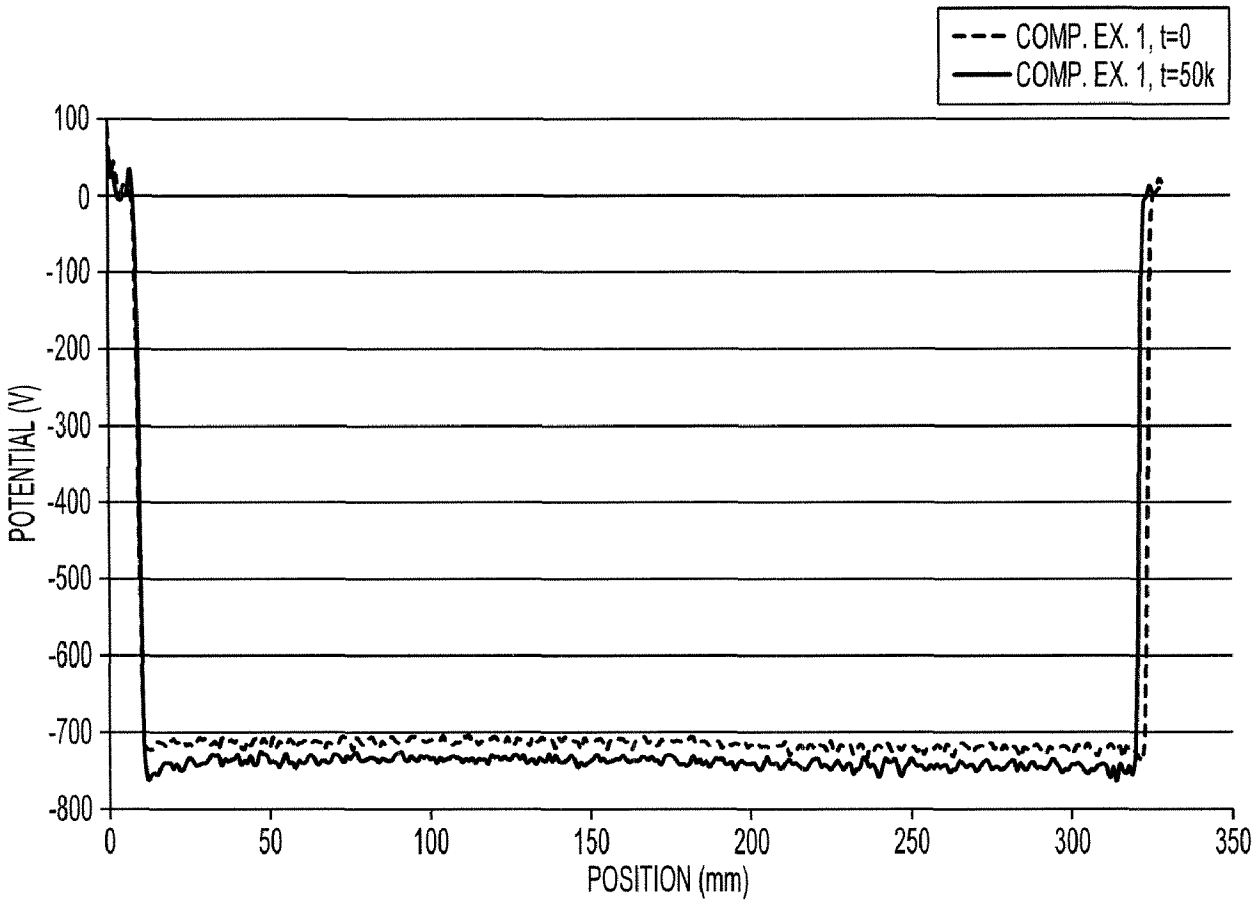
FIG. 4 is a graph showing the charge uniformity testing of a conventional bias charge roller lacking an overcoat layer.
Figure 5:
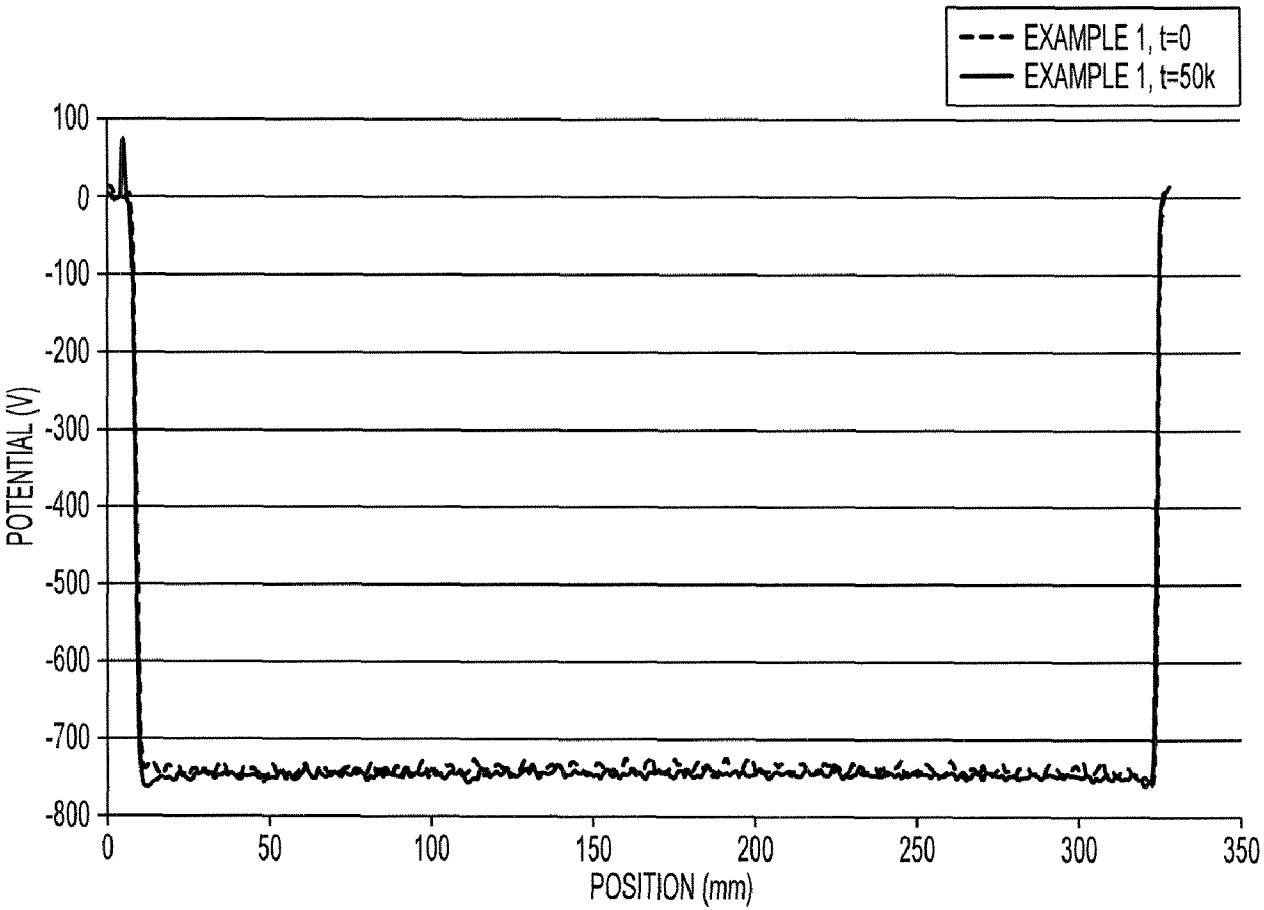
FIG. 5 is a graph showing the charge uniformity testing of a bias charge roller fabricated with an overcoat layer.

The charge uniformity tests for Comparative Example 1 are shown in FIG. 4, and the charge uniformity tests for Example 1 are shown in FIG. 5. For the x-axis of these graphs, 0 refers to one end of the roller and 328 refers to the other end of the roller. As can be seen in FIG. 4, the potential for Comparative Example 1 is a relatively straight line between the ends of the roller, both before and after the wear testing. Similarly, as seen in FIG. 5, the potential for Example 1 is also a relatively straight line between the ends of the roller, both before and after the wear testing. This indicated that there was no electrical charge build-up in the overcoat layers and no deterioration of charge capacity, i.e. that the addition of the overcoat layer did not affect the relevant electrical properties of the bias charge roller. In FIG. 5, the fact that there is no substantial difference between t=0 and t=50,000 indicates that Example 1, having an overcoat, is holding charge better than that of Comparative Example 1, which is seen in FIG. 4 as having a significant difference between t=0 and t=50,000.

Print Testing

Figure 6:
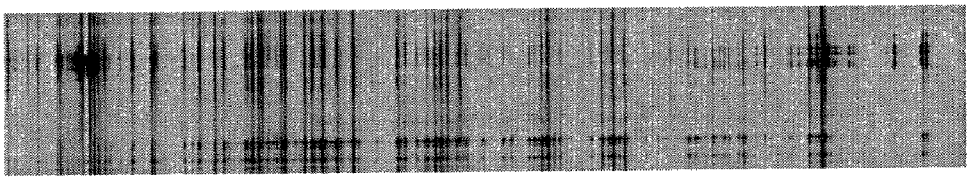
FIG. 6 illustrates a print image from a control imaging apparatus after 50,000 cycles wherein the bias charge roller does not have an overcoat layer.
Figure 7:
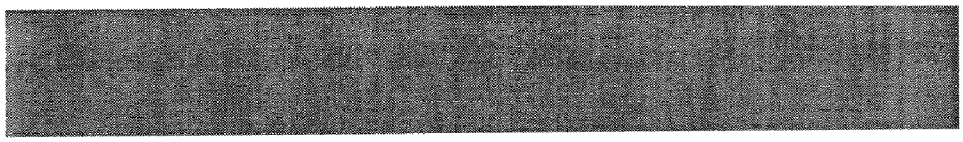
FIG. 7 illustrates a print image from an imaging apparatus fabricated with an overcoat layer after 50,000 cycles.

FIG. 6 shows the results of the print testing for the bias charge roller of Comparative Example 1 and FIG. 7 shows the results of the print testing for Example 1. The bias charge roller of Comparative Example 1 showed significant streaking. On the other hand, no print defects were observed in the bias charge roller of Example 1. This indicated that the bias charge roller of Comparative Example 1 sustained significant wear while the overcoat layer improved the wear resistance of the bias charge roller of Example 1.

While particular embodiments have been described, alternatives, modifications, variations, improvements, and substantial equivalents that are or may be presently unforeseen may arise to applicants or other skilled in the art. Accordingly, the appended claims as filed and as they are amended are intended to embrace all such alternatives, modifications, variations, improvements, and substantial equivalents.

What is claimed is:

1. A bias charge roller comprising a conductive core and an overcoat layer, wherein the overcoat layer comprises a phenolic resin and a conductive agent;

wherein the phenolic resin is a formaldehyde polymer generated with phenol, p-tert-butylphenol and cresol; a formaldehyde polymer generated with ammonia, cresol, and phenol; a formaldehyde polymer generated with 4,4'-(1-methylethylidene) bisphenol; a formaldehyde polymer generated with cresol and phenol; a formaldehyde polymer generated with phenol and p-tert-butylphenol; a nitrile phenolic; an epoxy phenolic; or a mixture thereof; and wherein the overcoat layer has a thickness of from about 0.1 μm to about 15 μm.

2. The bias charge roller of claim 1, wherein the conductive agent comprises carbon black.

3. The bias charge roller of claim 1, wherein the conductive agent comprises metal oxide particles.

4. The bias charge roller of claim 1, wherein the conductive agent comprises from about 4 to about 9 wt % of the overcoat layer.

5. The bias charge roller of claim 1, wherein the phenolic resin comprises from about 96 to about 91 wt % of the overcoat layer.

6. The bias charge roller of claim 1, wherein the overcoat layer has a surface resistivity of $10^5$ to $10^{13}$ ohm/sq.

7. A cartridge for applying an electrical charge to an associated imaging member, comprising:

a bias charge roller to be situated in proximity to a surface of the associated imaging member; and a power interface for supplying a voltage to the bias charge roller;

wherein the bias charge roller comprises an overcoat layer;

wherein the overcoat layer comprises a phenolic resin and a conductive agent;

wherein the phenolic resin is a formaldehyde polymer generated with phenol, p-tert-butylphenol and cresol; a formaldehyde polymer generated with ammonia, cresol, and phenol; a formaldehyde polymer generated with 4,4'-(1-methylethylidene) bisphenol; a formaldehyde polymer generated with cresol and phenol; a formaldehyde polymer generated with phenol and p-tert-butylphenol; a nitrile phenolic; an epoxy phenolic; or a mixture thereof; and wherein the overcoat layer has a thickness of from about 0.1 to about 15 μm.

8. The apparatus of claim 7, wherein the conductive agent comprises carbon black.

9. The apparatus of claim 7, wherein the conductive agent comprises metal oxide particles.

10. The apparatus of claim 7, wherein the conductive agent comprises from about 4 to about 9 wt % of the overcoat layer.

11. The apparatus of claim 7, wherein the phenolic resin comprises from about 96 to about 91 wt % of the overcoat layer.

12. The apparatus of claim 7, wherein the overcoat layer has a surface resistivity of $10^5$ to $10^{13}$ ohm/sq.

13. An image forming apparatus for forming images on a recording medium, comprising:

a) an electrophotographic imaging member having a charge-retentive surface to receive an electrostatic latent image thereon;

b) a development component to apply a developer material to the charge-retentive surface to form a developed image on the charge-retentive surface;

c) a transfer component for transferring the developed image from the charge-retentive surface to another member or a copy substrate;

d) a fusing member to fuse the developed image to the copy substrate; and e) a bias charge roller for applying a charge to the charge-retentive surface;

wherein the bias charge roller comprises an overcoat layer comprised of a phenolic resin and a conductive agent;

wherein the phenolic resin is a formaldehyde polymer generated with phenol, p-tert-butylphenol and cresol; a formaldehyde polymer generated with ammonia, cresol, and phenol; a formaldehyde polymer generated with 4,4'-(1-methylethylidene) bisphenol; a formaldehyde polymer generated with cresol and phenol; a formaldehyde polymer generated with phenol and p-tert-butylphenol; a nitrile phenolic; an epoxy phenolic; or a mixture thereof; and wherein the overcoat layer has a thickness of from about 0.1 to about 15 μm.

14. The image forming apparatus of claim 13, wherein the conductive agent comprises carbon black.

15. The image forming apparatus of claim 13, wherein the overcoat layer has a surface resistivity of $10^5$ to $10^{13}$ ohm/sq.

16. The bias charge roller of claim 1, wherein the overcoat layer has a thickness of from about 0.1 to about 5 μm.

17. The cartridge of claim 7, wherein the overcoat layer has a thickness of from about 0.1 to about 5 μm.

* * * * *